US005795440A

United States Patent [19]

Ampulski et al.

[11] Patent Number: 5,795,440

[45] Date of Patent: Aug. 18, 1998

[54] METHOD OF MAKING WET PRESSED TISSUE PAPER

[75] Inventors: Robert Stanley Ampulski, Fairfield; Ward William Ostendorf, West Chester; Osman Polat, Montgomery, all of Ohio

[73] Assignee: The Procter & Gamble Company, Cincinnati, Ohio

[21] Appl. No.: 671,993

[22] Filed: Jun. 28, 1996

Related U.S. Application Data

[63] Continuation-in-part of Ser. No. 460,949, Jun. 5, 1995, abandoned, which is a continuation-in-part of Ser. No. 358,661, Dec. 19, 1994, Pat. No. 5,637,194, which is a continuation-in-part of Ser. No. 170,140, Dec. 20, 1993, abandoned.

[51] Int. Cl.[6] ..... D21H 11/00

[52] U.S. Cl. ..... 162/117; 162/358.3

[58] Field of Search ..... 162/358.2, 358.3, 162/117, 109, DIG. 900, DIG. 901, 113, 115, 111

[56] References Cited

U.S. PATENT DOCUMENTS

| | | | |
|---|---|---|---|
| 3,014,832 | 12/1961 | Donnelly | 162/111 |
| 3,230,136 | 1/1966 | Krake | 162/111 |
| 3,301,746 | 1/1967 | Sanford et al. | 162/113 |
| 3,303,576 | 2/1967 | Sisson | 34/115 |
| 3,537,954 | 11/1970 | Justus | 162/305 |
| 3,629,056 | 12/1971 | Forrest | 162/305 |
| 3,824,152 | 7/1974 | Nevalainen | 162/301 |
| 3,840,429 | 10/1974 | Busker | 162/205 |
| 3,905,863 | 9/1975 | Ayers | 162/113 |
| 3,974,026 | 8/1976 | Emson et al. | 162/358 |
| 3,981,084 | 9/1976 | Sobota | 34/123 |
| 4,139,410 | 2/1979 | Tapio et al. | 162/206 |
| 4,144,124 | 3/1979 | Turunen et al. | 162/290 |
| 4,191,609 | 3/1980 | Trokhan | 162/113 |
| 4,196,045 | 4/1980 | Ogden | 162/117 |
| 4,201,624 | 5/1980 | Mohr et al. | 162/205 |
| 4,229,253 | 10/1980 | Cronin | 162/358 |
| 4,239,065 | 12/1980 | Trokhan | 139/383 |
| 4,287,021 | 9/1981 | Justus et al. | 162/358 |
| 4,309,246 | 1/1982 | Hulit et al. | 162/113 |
| 4,309,574 | 6/1983 | Wood | 428/36 |
| 4,356,059 | 10/1982 | Hostetler | 162/111 |
| 4,420,372 | 12/1983 | Hostetler | 162/280 |
| 4,421,600 | 12/1983 | Hostetler | 162/111 |
| 4,514,345 | 4/1985 | Johnson et al. | 264/136 |

(List continued on next page.)

FOREIGN PATENT DOCUMENTS

| | | |
|---|---|---|
| 320921 | 4/1981 | Canada . |
| 2109781 | 5/1994 | Canada . |
| 0 400 843 A2 | 5/1990 | European Pat. Off. . |
| WO 95/17548 | 6/1995 | WIPO . |
| WO 96/00812 | 1/1996 | WIPO . |
| WO 96/00813 | 1/1996 | WIPO . |
| WO 96/00814 | 1/1996 | WIPO . |

OTHER PUBLICATIONS

Rolf Maisch, Johann Moser and Voith Sulzer PaperAge Jan. 1996 pp. 24–27, "Highspeed Shoepress NipcoFlex Fractional Experiences From Perlen".

*Primary Examiner*—Brenda A. Lamb
*Attorney, Agent, or Firm*—Gerry S. Gressel; Larry L. Huston; E. Kelly Linman

[57] ABSTRACT

The present invention provides method for making a wet pressed paper web. An embryonic web of papermaking fibers is formed on a foraminous forming member, and transferred to an imprinting member to deflect a portion of the papermaking fibers in the embryonic web into deflection conduits in the imprinting member. The web and the imprinting member are then pressed between first and second dewatering felts in a compression nip to further deflect the papermaking fibers into the deflection conduits in the imprinting member and to remove water from both sides of the web. The compression nip has an extended length, and can comprise convex and concave opposed compression surfaces.

23 Claims, 7 Drawing Sheets

U.S. PATENT DOCUMENTS

| | | | |
|---|---|---|---|
| 4,529,480 | 7/1985 | Trokhan | 162/109 |
| 4,559,258 | 12/1985 | Kuichi | 428/156 |
| 4,561,939 | 12/1985 | Justus | 162/360.1 |
| 5,062,924 | 11/1991 | McCarten | 162/358 |
| 5,098,522 | 3/1992 | Smurkoski et al. | 162/358 |
| 5,178,732 | 1/1993 | Steiner et al. | 162/360.2 |
| 5,245,025 | 9/1993 | Trokhan et al. | 536/56 |
| 5,274,930 | 1/1994 | Ensign et al. | 34/23 |
| 5,308,450 | 5/1994 | Braun et al. | 162/360.2 |
| 5,389,205 | 2/1995 | Pajula et al. | 162/205 |
| 5,514,523 | 5/1996 | Trokhan et al. | 430/320 |
| 5,569,358 | 10/1996 | Cameron | 162/117 |
| 5,628,876 | 5/1997 | Ayers et al. | 162/358.2 |

METHOD OF MAKING WET PRESSED TISSUE PAPER

This application is a continuation-in-part of U.S. patent application Ser. No. 08/460,949 filed Jun. 5, 1995, now abandoned, which is a continuation-in-part of U.S. patent application Ser. No. 08/358,661 filed Dec. 19, 1994, now U.S. Pat. No. 5,637,194, which a continuation-in-part of U.S. patent application Ser. No. 08/170,140 filed Dec. 20, 1993, now abandoned.

FIELD OF THE INVENTION

The present invention is related to papermaking, and more particularly, to a method for making a wet pressed tissue paper web.

BACKGROUND OF THE INVENTION

Disposable products such as facial tissue, sanitary tissue, paper towels, and the like are typically made from one or more webs of paper. If the products are to perform their intended tasks, the paper webs from which they are formed must exhibit certain physical characteristics. Among the more important of these characteristics are strength, softness, and absorbency. Strength is the ability of a paper web to retain its physical integrity during use. Softness is the pleasing tactile sensation the user perceives as the user crumples the paper in his or her hand and contacts various portions of his or her anatomy with the paper web. Softness generally increases as the paper web stiffness decreases. Absorbency is the characteristic of the paper web which allows it to take up and retain fluids. Typically, the softness and/or absorbency of a paper web is increased at the expense of the strength of the paper web. Accordingly, papermaking methods have been developed in an attempt to provide soft and absorbent paper webs having desirable strength characteristics.

U.S. Pat. No. 3,301,746 issued to Sanford et al. discloses a paper web which is thermally pre-dried with a through air-drying system. Portions of the web are then impacted with a fabric knuckle pattern at the dryer drum. While the process of Sanford et al. is directed to providing improved softness and absorbency without sacrificing tensile strength, water removal using the through-air dryers of Sanford et al. is very energy intensive, and therefore expensive.

U.S. Pat. No. 3,537,954 issued to Justus discloses a web formed between an upper fabric and a lower forming wire. A pattern is imparted to the web at a nip where the web is sandwiched between the fabric and a relatively soft and resilient papermaking felt. U.S. Pat. No. 4,309,246 issued to Hulit et al. discloses delivering an uncompacted wet web to an open mesh imprinting fabric formed of woven elements, and pressing the web between a papermaker's felt and the imprinting fabric in a first press nip. The web is then carried by the imprinting fabric from the first press nip to a second press nip at a drying drum. U.S. Pat. No. 4,144,124 issued to Turunen et al. discloses a paper machine having a twin-wire former having a pair of endless fabrics, which can be felts. One of the endless fabrics carries a paper web to a press section. The press section can include the endless fabric which carries the paper web to the press section, an additional endless fabric which can be a felt, and a wire for pattern embossing the web.

Both Justus and Hulit et al. suffer from the disadvantage that they press a wet web in a nip having only one felt. During pressing of the web, water will exit both sides of the web. Accordingly, water exiting the surface of the web which is not in contact with a felt can re-enter the web at the exit of the press nip. Such re-wetting of the web at the exit of the press nip reduces the water removal capability of the press arrangement, disrupts fiber-to-fiber bonds formed during pressing, and can result in rebulking of the portions of the web which are densified in the press nip.

Turunen et al. discloses a press nip which includes two endless fabrics, which can be felts, and an imprinting wire. However, Turunen et al. does not transfer the web from a forming wire to an imprinting fabric to provide initial deflection of portions of the wet web into the imprinting fabric prior to pressing the web in the press nip. The web in Turunen can therefore be generally monoplanar at the entrance to the press nip, resulting in overall compaction of the web in the press nip. Overall compaction of the web is undesirable because it limits the difference in density between different portions of the web by increasing the density of relatively low density portions of the web.

In addition, Hulit et al., and Turunen et al. provide press arrangements wherein the imprinting fabric has discrete compaction knuckles, such as at the warp and weft crossover points of woven filaments. Discrete compacted sites do not provide a wet molded sheet having a continuous high density region for carrying loads and discrete low density regions for providing absorbency.

Embossing can also be used to impart bulk to a web. However, embossing of a dried web can result in disruption of bonds between fibers in the web. This disruption occurs because the bonds are formed and then set upon drying of the web. After the web is dried, moving fibers normal to the plane of the web disrupts fiber to fiber bonds, which in turn results in a web having less tensile strength than existed before embossing.

The following references disclose embossing: European Patent Application 0499942A2, U.S. Pat. No. 3,556,907, U.S. Pat. No. 3,867,225, U.S. Pat. No. 3,414,459, and U.S. Pat. No. 4,759,967.

As a result, paper scientists continue to search for improved paper structures that can be produced economically, and which provide increased strength without sacrificing softness and absorbency.

Accordingly, it is an object of the present invention to provide a method for dewatering and molding a paper web.

It is another object of the present invention to provide initial deflection of a portion of a paper web into an imprinting member, and subsequently pressing the resulting non-monoplanar web and the imprinting member between two deformable water receiving members in a press nip having an extended nip length.

Another object of the present invention is to provide a wet pressed paper web having increased strength for a given level of sheet flexibility.

Another object of the present invention is to provide a non-embossed patterned paper web having a relatively high density continuous network, a plurality of relatively low density domes dispersed throughout the continuous network, and a reduced thickness transition region at least partially encircling each of the low density domes.

SUMMARY OF THE INVENTION

The present invention provides a method for molding and dewatering a paper web. According to one embodiment of the present invention, an embryonic web of papermaking fibers is formed on a foraminous forming member, and transferred to an imprinting member to deflect a portion of the papermaking fibers in the embryonic web into deflection conduits in the imprinting member without densifying the embryonic web. The web and the imprinting member are then pressed between first and second dewatering felts in a compression nip to further deflect the papermaking fibers into the deflection conduits in the imprinting member and to remove water from both sides of the web. The compression nip has an extended nip length, the nip length being at least about 3.0 inches in the machine direction. The compression nip is formed between opposed compression surfaces. In a preferred embodiment, the compression nip is formed by a press having convex and concave opposed compression surfaces.

The method of the present invention comprises the steps of:

forming an embryonic web of the papermaking fibers on a foraminous forming member, the embryonic web having a first face and a second face;

transferring the embryonic web from the foraminous forming member to an imprinting member to position the second face of the embryonic web adjacent a web contacting face of the foraminous imprinting member;

deflecting a portion of the papermaking fibers in the embryonic web into a deflection conduit portion and removing water from the embryonic web through the deflection conduit portion to form an uncompacted, non-monoplanar intermediate web of the papermaking fibers; and pressing the web in a compression nip having a machine direction length of at least about 3.0 inches, wherein a first felt layer is positioned adjacent the first face of the intermediate web, wherein the web imprinting surface is positioned adjacent the second face of the intermediate web, and wherein the deflection conduit portion is in flow communication with a second felt layer.

In one embodiment, the step of pressing the intermediate web comprises pressing the intermediate web in a compression nip having a machine direction length of between about 3.0 to about 20.0 inches, and more preferably between about 4.0 and about 10.0 inches.

The step of pressing the intermediate web can comprise pressing the intermediate web at a nip loading of between about 400 pounds per lineal inch of cross machine direction nip width and about 10000 pounds per lineal inch of cross machine direction nip width.

BRIEF DESCRIPTION OF THE DRAWINGS

While the specification concludes with claims particularly pointing out and distinctly claiming the present invention, the invention will be better understood from the following description taken in conjunction with the accompanying drawings in which:

DETAILED DESCRIPTION OF THE INVENTION

Figure 1:
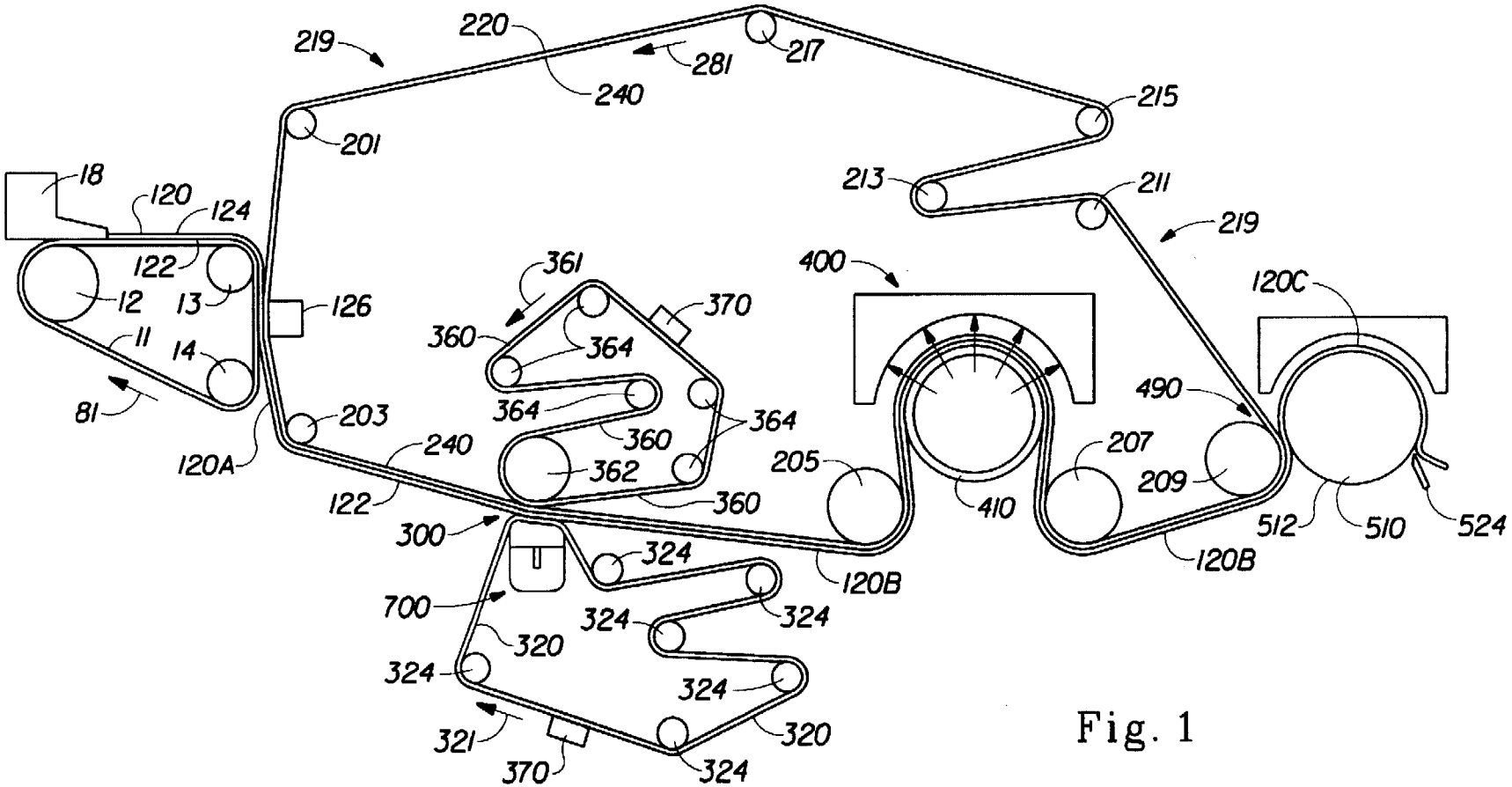
FIG. 1 is a schematic representation of one embodiment of a continuous papermaking machine illustrating transferring a paper web from a foraminous forming member to a foraminous imprinting member, carrying the paper web on the foraminous imprinting member to a compression nip, and pressing the web carried on the foraminous imprinting member between first and second dewatering felts in the compression nip.

FIG. 1 illustrates one embodiment of a continuous papermaking machine which can be used in practicing the present invention. The process of the present invention comprises a number of steps or operations which occur in sequence. While the process of the present invention is preferably carried out in a continuous fashion, it will be understood that the present invention can comprise a batch operation, such as a handsheet making process. A preferred sequence of steps will be described, with the understanding that the scope of the present invention is determined with reference to the appended claims.

According to one embodiment of the present invention, an embryonic web 120 of papermaking fibers is formed from an aqueous dispersion of papermaking fibers on a foraminous forming member 11. The embryonic web 120 is then transferred to a foraminous imprinting member 219 having a first web contacting face 220 comprising a web imprinting surface and a deflection conduit portion. A portion of the papermaking fibers in the embryonic web 120 are deflected into the deflection conduit portion of the foraminous imprinting member 219 without densifying the web, thereby forming an intermediate web 120A.

The intermediate web 120A is carried on the foraminous imprinting member 219 from the foraminous forming member 11 to a compression nip 300 having a machine direction length of at least about 3.0 inches. The nip 300 has opposed compression surfaces. The opposed compression surfaces can be opposed convex and concave compression surfaces, with the convex compression surface being provided by a press roll 362 and the opposed concave compression surface being provided by a shoe press assembly 700.

A first dewatering felt 320 is positioned adjacent the intermediate web 120A, and a second dewatering felt 360 is positioned adjacent the foraminous imprinting member 219. The intermediate web 120A and the foraminous imprinting member 219 are then pressed between the first and second dewatering felts 320 and 360 in the compression nip 300 to further deflect a portion of the papermaking fibers into the deflection conduit portion of the imprinting member 219; to density a portion of the intermediate web 120A associated with the web imprinting surface; and to further dewater the web by removing water from both sides of the web, thereby forming a molded web 120B which is relatively dryer than the intermediate web 120A.

The molded web 120B is carried from the compression nip 300 on the foraminous imprinting member 219. The molded web 120B can be pre-dried in a through air dryer 400 by directing heated air to pass first through the molded web, and then through the foraminous imprinting member 219, thereby further drying the molded web 120B. The web imprinting surface of the foraminous imprinting member 219 can then be impressed into the molded web 120B such as at a nip formed between a roll 209 and a dryer drum 510, thereby forming an imprinted web 120C. Impressing the web imprinting surface into the molded web can further density the portions of the web associated with the web imprinting surface. The imprinted web 120C can then be dried on the dryer drum 510 and creped from the dryer drum by a doctor blade 524.

Examining the process steps according to the present invention in more detail, a first step in practicing the present invention is providing an aqueous dispersion of papermaking fibers derived from wood pulp to form the embryonic web 120. The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex™, available from Hercules, Inc. (Wilmington, Del.). Applicable wood pulps include chemical pulps, such as Kraft, sulfite, and sulfate pulps, as well as mechanical pulps including, for example, groundwood, thermomechanical pulp and chemically modified thermomechanical pulp. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

In addition to papermaking fibers, other components or materials may be added to the papermaking furnish. The types of additives desirable win be dependent upon the particular end use of the tissue sheet contemplated. For example, in products such as toilet paper, paper towels, facial tissues and other similar products, high wet strength is a desirable attribute. Thus, it is often desirable to add to the papermaking furnish chemical substances known in the art as "wet strength" resins.

A general dissertation on the types of wet strength resins utilized in the paper art can be found in TAPPI monograph series No. 29, Wet Strength in Paper and Paperboard, Technical Association of the Pulp and Paper Industry (New York, 1965). The most useful wet strength resins have generally been cationic in character. Polyamide-epichlorohydrin resins are cationic wet strength resins which have been found to be of particular utility. Suitable types of such resins are described in U.S. Pat. Nos. 3,700,623, issued on Oct. 24, 1972, and 3,772,076, issued on Nov. 13, 1973, both issued to Keim and both being hereby incorporated by reference. One commercial source of a useful polyamide-epichlorohydrin resins is Hercules, Inc. of Wilmington, Del., which markets such resin under the mark Kymene™ 557H.

Polyacrylamide resins have also been found to be of utility as wet strength resins. These resins are described in U.S. Pat. Nos. 3,556,932, issued on Jan. 19, 1971, to Coscia, et al. and 3,556,933, issued on Jan. 19, 1971, to Williams et al., both patents being incorporated herein by reference. One commercial source of polyacrylamide resins is American Cyanamid Co. of Stanford, Conn., which markets one such resin under the mark Parez™ 631 NC.

Still other water-soluble cationic resins finding utility in this invention are urea formaldehyde and melamine formaldehyde resins. The more common functional groups of these polyfunctional resins are nitrogen containing groups such as amino groups and methylol groups attached to nitrogen. Polyethylenimine type resins may also find utility in the present invention. In addition, temporary wet strength resins such as Caldas 10 (manufactured by Japan Carlit) and CoBond 1000 (manufactured by National Starch and Chemical Company) may be used in the present invention. It is to be understood that the addition of chemical compounds such as the wet strength and temporary wet strength resins discussed above to the pulp furnish is optional and is not necessary for the practice of the present development.

The embryonic web 120 is preferably prepared from an aqueous dispersion of the papermaking fibers, though dispersions of the fibers in liquids other than water can be used. The fibers are dispersed in water to form an aqueous dispersion having a consistency of from about 0.1 to about 0.3 percent. The percent consistency of a dispersion, slurry, web, or other system is defined as 100 times the quotient obtained when the weight of dry fiber in the system under discussion is divided by the total weight of the system. Fiber weight is always expressed on the basis of bone dry fibers.

A second step in the practice of the present invention is forming the embryonic web 120 of papermaking fibers. Referring to FIG. 1, an aqueous dispersion of papermaking fibers is provided to a headbox 18 which can be of any convenient design. From the headbox 18 the aqueous dispersion of papermaking fibers is delivered to a foraminous forming member 11 to form an embryonic web 120. The forming member 11 can comprise a continuous Fourdrinier wire. Alternatively, the foraminous forming member 11 can comprise a plurality of polymeric protuberances joined to a continuous reinforcing structure to provide an embryonic web 120 having two or more distinct basis weight regions, such as is disclosed in U.S. Pat. No. 5,245,025 issued Sep.

14, 1993 to Trokhan et al, which patent is incorporated herein by reference. While a single forming member 11 is shown in FIG. 1, single or double wire forming apparatus may be used. Other forming wire configurations, such as S or C wrap configurations can be used.

The forming member 11 is supported by a breast roll 12 and plurality of return rolls, of which only two return rolls 13 and 14 are shown in FIG. 1. The forming member 11 is driven in the direction indicated by the arrow 81 by a drive means not shown. The embryonic web 120 is formed from the aqueous dispersion of papermaking fibers by depositing the dispersion onto the foraminous forming member 11 and removing a portion of the aqueous dispersing medium. The embryonic web 120 has a first web face 122 contacting the foraminous member 11 and a second oppositely facing web face 124.

The embryonic web 120 can be formed in a continuous papermaking process, as shown in FIG. 1, or alternatively, a batch process, such as a handsheet making process can be used. After the aqueous dispersion of papermaking fibers is deposited onto the foraminous forming member 11, the embryonic web 120 is formed by removal of a portion of the aqueous dispersing medium by techniques well known to those skilled in the art. Vacuum boxes, forming boards, hydrofoils, and the like are useful in effecting water removal from the aqueous dispersion on the foraminous forming member 11. The embryonic web 120 travels with the forming member 11 about the return roll 13 and is brought into the proximity of a foraminous imprinting member 219.

Figure 2:
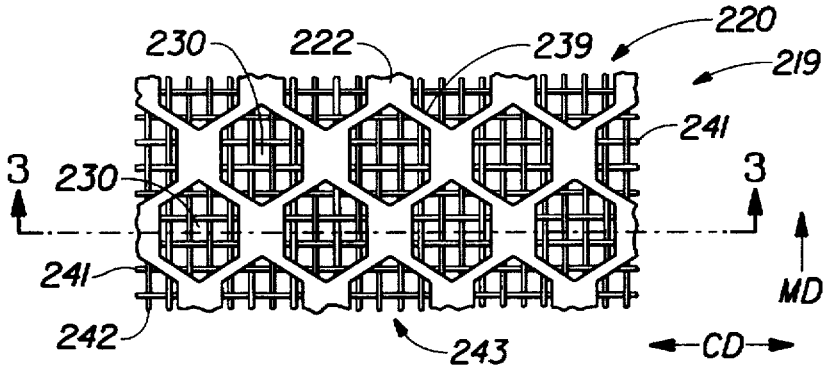
FIG. 2 is a schematic illustration of a plan view of a foraminous imprinting member having a first web contacting face comprising a macroscopically monoplanar, patterned continuous network web imprinting surface defining within the foraminous imprinting member a plurality of discrete, isolated, non connecting deflection conduits.
Figure 3:
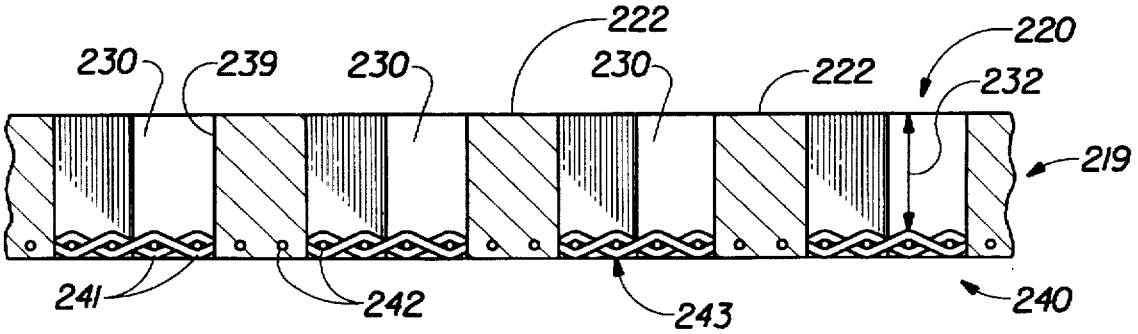
FIG. 3 is a cross-sectional view of a portion of the foraminous imprinting member shown in FIG. 2 as taken along line 3—3.

The foraminous imprinting member 219 has a first web contacting face 220 and a second felt contacting face 240. The web contacting face 220 has a web imprinting surface 222 and a deflection conduit portion 230, as shown in FIGS. 2 and 3. The deflection conduit portion 230 forms at least a portion of a continuous passageway extending from the first face 220 to the second face 240 for carrying water through the foraminous imprinting member 219. Accordingly, when water is removed from the web of papermaking fibers in the direction of the foraminous imprinting member 219, the water can be disposed of without having to again contact the web of papermaking fibers. The foraminous imprinting member 219 can comprise an endless belt, as shown in FIG. 1, and can be supported by a plurality of rolls 201–217. The foraminous imprinting member 219 is driven in the direction 281 (corresponding to the machine direction) shown in FIG. 1 by a drive means (not shown). The first web contacting face 220 of the foraminous imprinting member 219 can be sprayed with an emulsion comprising about 90 percent by weight water, about 8 percent petroleum oil, about 1 percent cetyl alcohol, and about 1 percent of a surfactant such as Adogen TA-100. Such an emulsion facilitates transfer of the web from the imprinting member 219 to the drying drum 510. Of course, it will be understood that the foraminous imprinting member 219 need not comprise an endless belt if used in making handsheets in a batch process.

In the embodiment shown in FIGS. 2 and 3, the first web contacting face 220 of the foraminous imprinting member 219 comprises a macroscopically monoplanar, patterned, continuous network web imprinting surface 222. The continuous network web imprinting surface 222 defines within the foraminous imprinting member 219 a plurality of discrete, isolated, non-connecting deflection conduits 230. The deflection conduits 230 have openings 239 which can be random in shape and in distribution, but which are preferably of uniform shape and distributed in a repeating, preselected pattern on the first web contacting face 220. Such a continuous network web imprinting surface 222 and discrete deflection conduits 230 are useful for forming a paper structure having a continuous, relatively high density network region 1083 and a plurality of relatively low density domes 1084 dispersed throughout the continuous, relatively high density network region 1083, as shown in FIGS. 6 and 7.

Suitable shapes for the openings 239 include, but are not limited to, circles, ovals, and polygons, with hexagonal shaped openings 239 shown in FIG. 2. The openings 239 can be regularly and evenly spaced in aligned ranks and files. Alternatively, the openings 239 can be bilaterally staggered in the machine direction (MD) and cross-machine direction (CD), as shown in FIG. 2, where the machine direction refers to that direction which is parallel to the flow of the web through the equipment, and the cross machine direction is perpendicular to the machine direction. A foraminous imprinting member 219 having a continuous network web imprinting surface 222 and discrete isolated deflection conduits 230 can be manufactured according to the teachings of the following U.S. Patents which are incorporated herein by reference: U.S. Pat. No. 4,514,345 issued Apr. 30, 1985 to Johnson et al.; U.S. Pat. No. 4,529,480 issued Jul. 16, 1985 to Trokhan; and U.S. Pat. No. 5,098,522 issued Mar. 24, 1992 to Smurkoski et al.; and 5,514,523 issued May 7, 1996 to Trokhan et al.

Referring to FIGS. 2 and 3, the foraminous imprinting member 219 can include a woven reinforcement element 243 for strengthening the foraminous imprinting member 219. The reinforcement element 243 can include machine direction reinforcing strands 242 and cross machine direction reinforcing strands 241, though any convenient weave pattern can be used. The openings in the woven reinforcement element 243 formed by the interstices between the strands 241 and 242 are smaller than the size of the openings 239 of the deflection conduits 230. Together, the openings in the woven reinforcement element 243 and the openings 239 of the deflection conduits 230 provide a continuous passageway extending from the first face 220 to the second face 240 for carrying water through the foraminous imprinting member 219. The reinforcement element 243 can also provide a support surface for limiting deflection of the fibers into the deflection conduits 230, and thereby help to prevent the formation of apertures in the portions of the web associated with the deflection conduits 230, such as the relatively low density domes 1084. Such apertures, or pinholing, can be caused by water or air flow through the deflection conduits when a pressure difference exists across the web.

Figure 6:
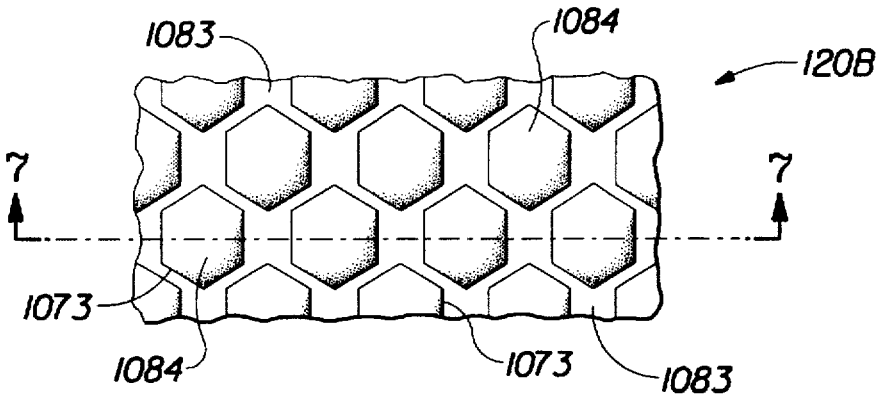
FIG. 6 is a schematic illustration of a plan view of a molded paper web formed using the foraminous imprinting member of FIGS. 2 and 3.
Figure 7:
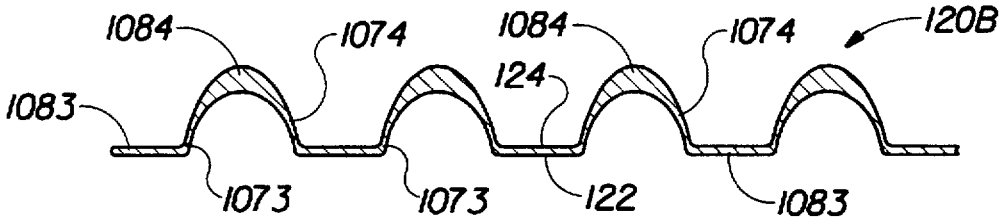
FIG. 7 is a schematic cross-sectional illustration of the paper web of FIG. 6 taken along line 7—7 of FIG. 6.

The area of the web imprinting surface 222, as a percentage of the total area of the first web contacting surface 220, should be between about 15 percent to about 65 percent, and more preferably between about 20 percent to about 50 percent to provide a desirable ratio of the areas of the relatively high density region 1083 and the relatively low density domes 1084 shown in FIGS. 6 and 7. The size of the openings 239 of the deflection conduits 230 in the plane of the first face 220 can be expressed in terms of effective free span. Effective free span is defined as the area of the opening 239 in the plane of the first face 220 divided by one fourth of the perimeter of the opening 239. The effective free span should be from about 0.25 to about 3.0 times the average length of the papermaking fibers used to form the embryonic web 120, and is preferably from about 0.5 to about 1.5 times the average length of the papermaking fibers. The deflection conduits 230 can have a depth 232 (FIG. 3) which is between about 0.1 mm and about 1.0 mm.

In an alternative embodiment, the foraminous imprinting member 219 can comprise a fabric belt formed of woven filaments. The web imprinting surface 222 can be formed by discrete knuckles formed at the cross-over points of the woven filaments. Suitable woven filament fabric belts for use as the foraminous imprinting member 219 are disclosed in U.S. Pat. No. 3,301,746 issued Jan. 31, 1967 to Sanford et al., U.S. Pat. No. 3,905,863 issued Sep. 16, 1975 to Ayers, U.S. Pat. No. 4,191,609 issued Mar. 4, 1980 to Trokhan, and U.S. Pat. No. 4,239,065 issued Dec. 16, 1980 to Trokhan, which patents are incorporated herein by reference.

Figure 11:
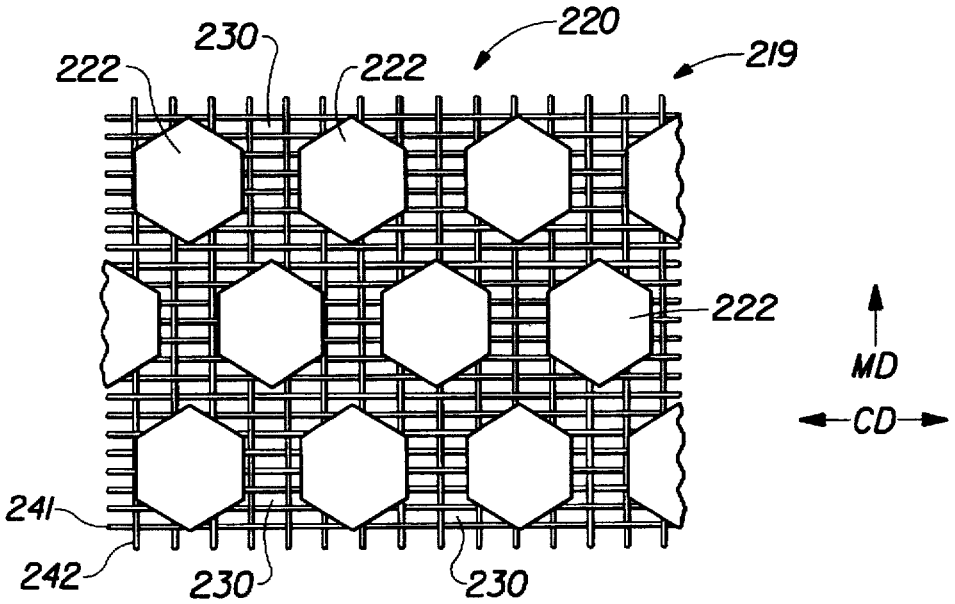
FIG. 11 is a schematic illustration of a plan view of a foraminous imprinting member having a web contacting face comprising a continuous, patterned deflection conduit and a plurality of discrete, isolated web imprinting surfaces.

In another alternative embodiment, the foraminous imprinting member 219 can have a first web contacting face 220 comprising a continuous patterned deflection conduit 230 encompassing a plurality of discrete, isolated web imprinting surfaces 222. Such a foraminous imprinting member 219 can be used to form a molded web having a continuous, relatively low density network region, and a plurality of discrete, relatively high density regions dispersed throughout the continuous, relatively low density network. Such a foraminous imprinting member is shown in FIG. 11, as well as in U.S. Pat. No. 4,514,345 issued Apr. 30, 1985 to Johnson et al., which patent is incorporated herein by reference.

Figure 12:
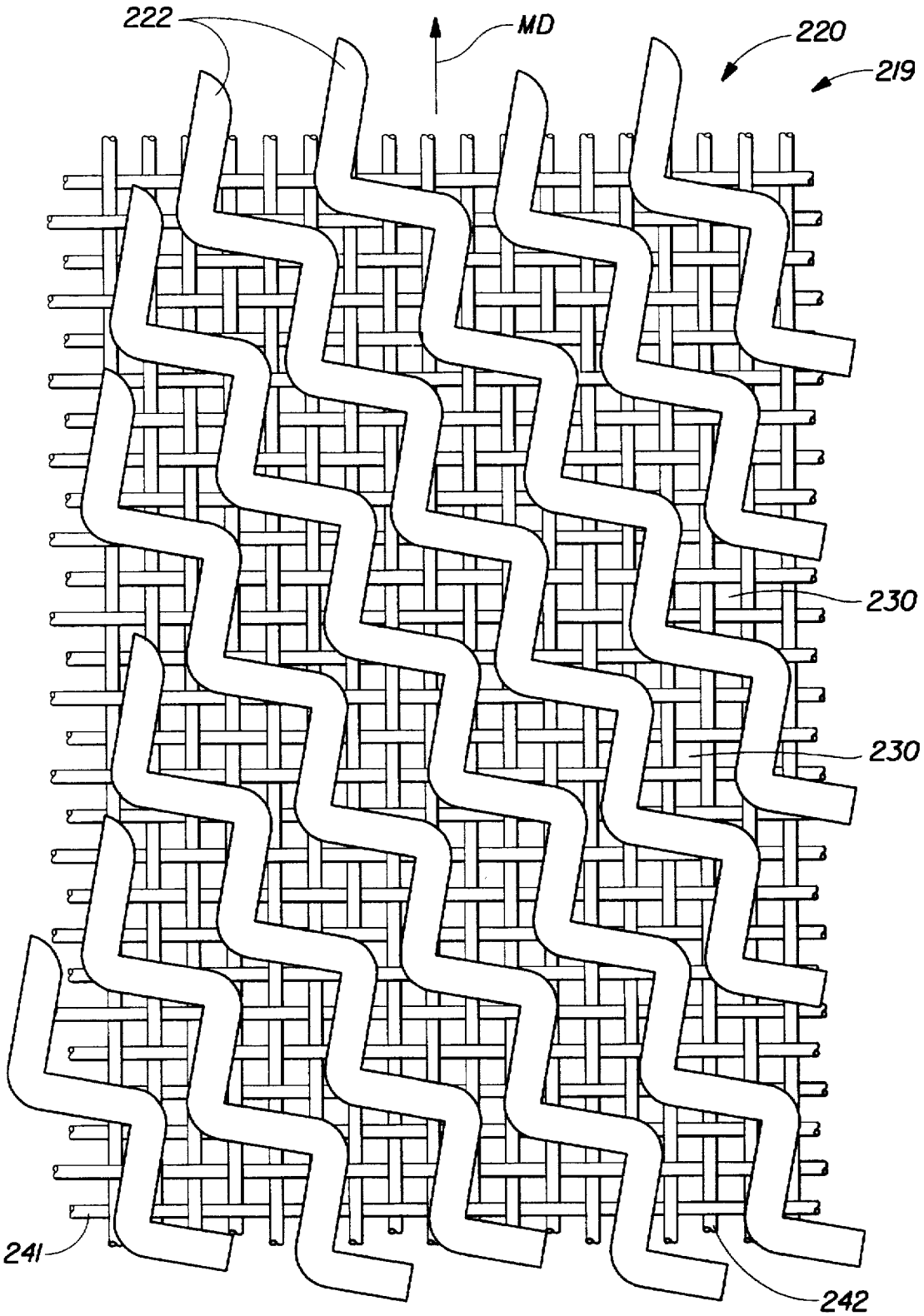
FIG. 12 is a schematic illustration of a plan view of a foraminous imprinting member having a semi-continuous web imprinting surface.

In yet another embodiment, the foraminous imprinting member 219 can have a first web contacting face 220 comprising a plurality of semicontinuous web imprinting surfaces 222. As used herein, a pattern of web imprinting surfaces 222 is considered to be semicontinuous if a plurality of the imprinting surfaces 222 extend substantially unbroken along any one direction on the web contacting face 220, and each imprinting surface is spaced apart from adjacent imprinting surfaces 220 by a deflection conduit 230. The web contacting face 220 can have adjacent semicontinuous imprinting surfaces 222 spaced apart by semicontinuous deflection conduits 230. The semicontinuous imprinting surfaces 222 can extend generally parallel to the machine or cross-machine directions, or alternatively, extend along a direction forming an angle with respect to the machine and cross-machine directions. Such a foraminous imprinting member is shown in FIG. 12, as well as in U.S. Pat. No. 5,628,876 issued May 13, 1997, which is a continuation of U.S. patent application Ser. No. 07/936,954, Papermaking Belt Having Semicontinuous Pattern and Paper Made Thereon, filed Aug. 26, 1992 in the name of Ayers et al., which applications is incorporated herein by reference.

A third step in the practice of the present invention comprises transferring the embryonic web 120 from the foraminous forming member 11 to the foraminous imprinting member 219, to position the second web face 124 on the first web contacting face 220 of the foraminous imprinting member 219.

A fourth step in the practice of the present invention comprises deflecting a portion of the papermaking fibers in the embryonic web 120 into the deflection conduit portion 230 of web contacting face 220, and removing water from the embryonic web 120 through the deflection conduit portion 230 to form an intermediate web 120A of the papermaking fibers. The embryonic web 120 preferably has a consistency of between about 3 and about 20 percent at the point of transfer to facilitate deflection of the papermaking fibers into the deflection conduit portion 230.

The steps of transferring the embryonic web 120 to the imprinting member 219 and deflecting a portion of the papermaking fibers in the web 120 into the deflection conduit portion 230 can be provided, at least in part, by applying a differential fluid pressure to the embryonic web 120. For instance, the embryonic web 120 can be vacuum transferred from the forming member 11 to the imprinting member 219, such as by a vacuum box 126 shown in FIG. 1, or alternatively, by a rotary pickup vacuum roll (not shown). The pressure differential across the embryonic web 120 provided by the vacuum source (e.g., the vacuum box 126) deflects the fibers into the deflection conduit portion 230, and preferably removes water from the web through the deflection conduit portion 230 to raise the consistency of the web to between about 18 and about 30 percent. The pressure differential across the embryonic web 120 can be between about 13.5 kPa and about 40.6 kPa (between about 4 to about 12 inches of mercury). The vacuum provided by the vacuum box 126 permits transfer of the embryonic web 120 to the foraminous imprinting member 219 and deflection of the fibers into the deflection conduit portion 230 without compacting the embryonic web 120. Additional vacuum boxes (not shown) can be included to further dewater the intermediate web 120A.

Figure 4:
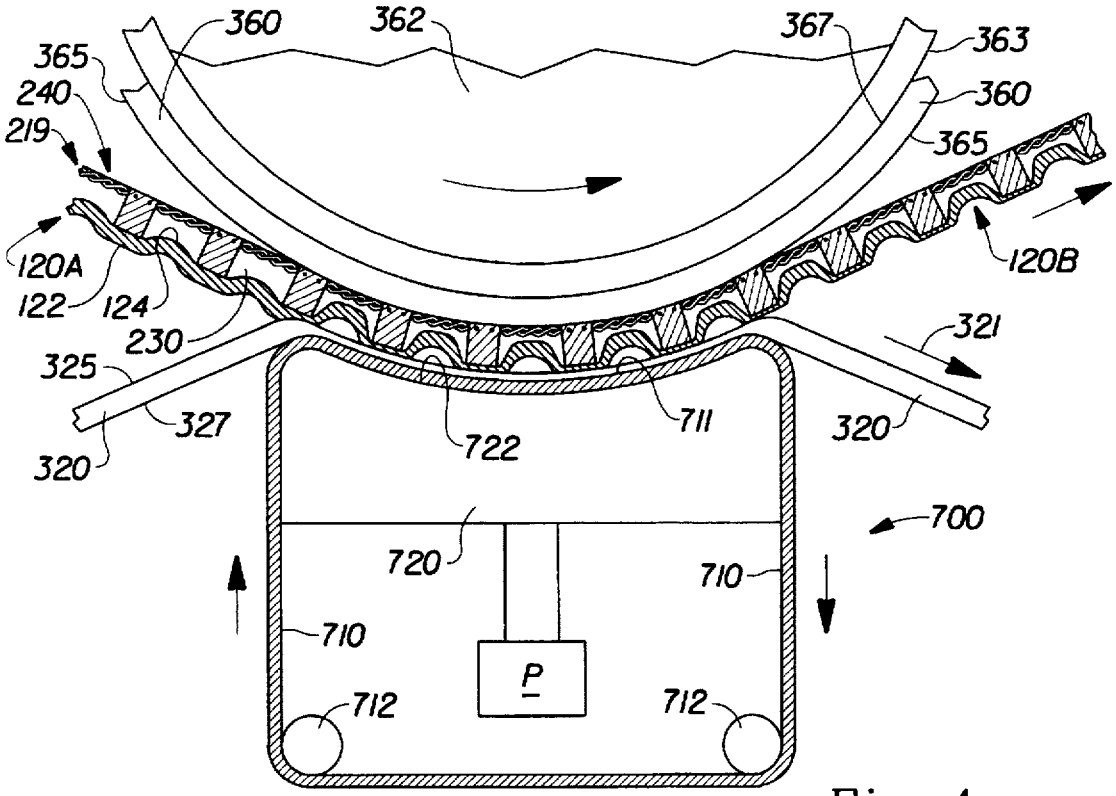
FIG. 4 is an enlarged schematic illustration of the compression nip shown in FIG. 1, showing a first dewatering felt positioned adjacent a first face of the web, the web contacting face of the foraminous imprinting member positioned adjacent the second face of the web, and a second dewatering felt positioned adjacent the second felt contacting face of the foraminous imprinting member, wherein the compression nip comprises opposed convex and concave compression surfaces.

Referring to FIG. 4, portions of the intermediate web 120A are shown deflected into the deflection conduits 230 upstream of the compression nip 300, so that the intermediate web 120A is non-monoplanar. The intermediate web 120A is shown having a generally uniform thickness (distance between first and second web faces 122 and 124) upstream of the compression nip 300 to indicate that a portion of the intermediate web 120A has been deflected into the imprinting member 219 without locally densifying or compacting the intermediate web 120A upstream of the compression nip 300. Transfer of the embryonic web 120 and deflection of the fibers in the embryonic web into the deflection conduit portion 230 can be accomplished essentially simultaneously. Above referenced U.S. Pat. No. 4,529,480 is incorporated herein by reference for the purpose of teaching a method for transferring an embryonic web to a foraminous member and deflecting a portion of the papermaking fibers in the embryonic web into the foraminous member.

A fifth step in the practice of the present invention comprises pressing the wet intermediate web 120A in the compression nip 300 to form the molded web 120B. Referring to FIGS. 1 and 4, the intermediate web 120A is carried on the foraminous imprinting member 219 from the foraminous forming member 11 and through the compression nip 300 formed between the opposed compression surfaces of roll 362 and shoe press assembly 700. In order to describe the operation of the compression nip 300, the imprinting member 219, dewatering felts 320 and 360, and the paper web are drawn enlarged relative to the roll 362 and the press assembly 700.

The first dewatering felt 320 is shown supported in the compression nip adjacent the press shoe assembly 700, and is driven in the direction 321 around a plurality of felt support rolls 324. The shoe press assembly 700 includes a fluid impervious pressure belt 710, a pressure shoe 720, and pressure source P. The pressure shoe 720 can have a generally arcuate, concave surface 722. The pressure belt 710 travels in a continuous path over the generally concave surface 722 and the guide rolls 712. The pressure source P provides hydraulic fluid under pressure to a cavity (not shown) in the pressure shoe 720. The pressurized fluid in the cavity urges the pressure belt 710 against the felt 320, and provides the loading of the compression nip 300. Shoe press assemblies are disclosed generally in the following U.S. Patents, which are incorporated herein by reference: U.S. Pat. No. 4,559,258 to Kiuchi; U.S. Pat. No. 3,974,026 to Emson et al.; U.S. Pat. No. 4,287,021 to Justus et al.; U.S.

Pat. No. 4,201,624 to Mohr et al.; U.S. Pat. No. 4,229,253 to Cronin; U.S. Pat. No. 4,561,939 to Justus; U.S. Pat. No. 5,389,205 to Pajula et al.; U.S. Pat. No. 5,178,732 to Steiner et al.; U.S. Pat. No. 5,308,450 to Braun et al.

The outer surface of the pressure belt 710 takes on a generally arcuate, concave shape as it passes over the pressure shoe 720, and provides a concave compression surface facing oppositely to the convex compression surface provided by press roll 362. This portion of the outer surface of the pressure belt 710 passing over the pressure shoe is designated 711 in FIG. 4. The outer surface of the pressure belt 710 can be smooth or grooved.

The convex compression surface provided by the press roll 362 in combination with the oppositely facing concave compression surface provided by the shoe press assembly 700 provide an arcuate compression nip having machine direction length which is at least about 3.0 inch. In one embodiment, the compression nip 300 has a machine direction length of between about 3.0 to about 20.0 inches, and more preferably between about 4.0 inches and about 10.0 inches.

The second dewatering felt 360 is shown supported in the compression nip 300 adjacent the nip roll 362 and driven in the direction 361 around a plurality of felt support rolls 364. A felt dewatering apparatus 370, such as a Uhle vacuum box can be associated with each of the dewatering felts 320 and 360 to remove water transferred to the dewatering felts from the intermediate web 120A.

The press roll 362 can have a generally smooth surface. Alternatively, the roll 362 can be grooved, or have a plurality of openings in flow communication with a source of vacuum for facilitating water removal from the intermediate web 120A. The roll 362 can have a rubber coating 363, such as a bonehard rubber cover, which can be smooth, grooved, or perforated. The rubber coating 363 shown in FIG. 4 provides a convex compression surface which faces oppositely to the concave compression surface 711 provided by the shoe press assembly 700.

The term "dewatering felt" as used herein refers to a member which is absorbent, compressible, and flexible so that it is deformable to follow the contour of the non-monoplanar intermediate web 120A on the imprinting member 219, and capable of receiving and containing water pressed from an intermediate web 120A. The dewatering felts 320 and 360 can be formed of natural materials, synthetic materials, or combinations thereof. A suitable dewatering felt comprises a nonwoven batt of natural or synthetic fibers joined, such as by needling, to a support structure formed of woven filaments. Suitable materials from which the nonwoven batt can be formed include but are not limited to natural fibers such as wool and synthetic fibers such as polyester and nylon. The fibers from which the batt 240 is formed can have a denier of between about 3 and about 40 grams per 9000 meters of filament length. The felt can have a layered construction, and comprise a mixture of fiber types and sizes.

The dewatering felts 320 and 360 can have a thickness of between about 2 mm to about 5 mm, a basis weight of about 800 to about 2000 grams per square meter, an average density (basis weight divided by thickness) of between about 0.35 gram per cubic centimeter and about 0.45 gram per cubic centimeter, and an air permeability of between about 15 and about 110 cubic feet per minute per square foot, at a pressure differential across the dewatering felt thickness of 0.12 kPa (0.5 inch of water).

The dewatering felt 320 can have a first surface 325 having a relatively high density, relatively small pore size, and a second surface 327 having a relatively low density, relatively large pore size. Likewise, the dewatering felt 360 can have a first surface 365 having a relatively high density, relatively small pore size, and a second surface 367 having a relatively low density, relatively large pore size.

The dewatering felts 320 and 360 can have a compressibility of between 20 and 80 percent, preferably between 30 and 70 percent, and more preferably between 40 and 60 percent. The "compressibility" as used herein is a measure of the percentage change in thickness of the dewatering felt under a given loading defined below. The dewatering felts 320 and 360 should also have a modulus of compression less than 10000 psi, preferably less than 7000 psi, more preferably less than 5000 psi, and most preferably between about 1000 and about 4000 psi. The "modulus of compression" as used herein is a measure of the rate of change of loading with change in thickness of the dewatering felt. The compressibility and modulus of compression are measured using the following procedure. The dewatering felt is placed on a papermaking fabric formed of woven polyester monofilaments having a diameter of about 0.40 millimeter and having a square weave pattern of about 36 filaments per inch in a first direction, and about 30 filaments per inch in a second direction perpendicular to the first direction. The papermaking fabric has thickness under no compressive loading of about 0.68 millimeter (0.027 inch). Such a papermaking fabric is commercially available from the Appleton Wire Company of Appleton, Wis. The dewatering felt is positioned so that the surface of the dewatering felt which is normally in contact with the paper web is adjacent the papermaking fabric. The felt-fabric pair is then compressed with a constant rate tensile/compression tester, such as an Instron Model 4502 available from the Instron Engineering Corporation of Canton, Mass. The tester has a circular compression foot having a surface area of about 13 square centimeters (2.0 square inches) attached to a crosshead moving at a rate of 5.08 centimeters per minute (2.0 inch per minute). The thickness of the felt-fabric pair is measured at loads of 0 psi, 300 psi, 450 psi, and 600 psi, where the load in psi is calculated by dividing the load in pounds obtained from the tester load cell by the surface area of the compression foot. The thickness of the fabric alone is also measured at 0 psi, 300 psi, 450 psi, and 600 psi loads. The compressibility and modulus of compression in psi are calculated using the following equations:

$$\text{Compressibility}=100\times((TFP0-TP0)-(TFP450-TP450))/(TFP0-TP0)$$

$$\text{Modulus of Compression}=(300\text{ psi})\times(TFP300-TP300)/((TFP300-TP300)-(TFP600-TP600))$$

where TFP0, TFP300, TFP450, and TFP600 are the thicknesses of the felt-fabric pair at 0 psi, 300 psi, 450 psi and 600 psi loads, respectively, and TP0, TP300, TP450, and TP600 are the thicknesses of the fabric alone at 0 psi, 300 psi, 450 psi, and 600 psi loads, respectively. Suitable dewatering felts 320 and 360 are commercially available as SUPERFINE DURAMESH style XY31620 from the Albany International Company of Albany, N.Y.

Alternatively, the dewatering felts 320 and 360 can have different constructions. For instance, the felt 360 can be selected to have an air permeability of at least about 30 cubic feet per minute per square foot. The felt 320 can have an air permeability which is lower than that of felt 360. In one embodiment, felt 360 can be an AmFlex-3S Style 5615 having a 1:1 batt to base ratio (1 pound batt material for every one pound of woven base reinforcing structure) and a 3 over 40 layered batt construction (3 denier fibers over 40 denier fibers, where the 3 denier fibers are adjacent the surface 365 of the felt layer). Such a felt is available from Appleton Mills of Appleton, Wis. and can have an air permeability of about 40 cubic feet per minute per square foot. Felt 320 can be an AmSeam-2, Style 2732 having a 1:1 batt to base ratio and a 3 over 6 layered batt construction. Such a felt is available from Appleton Mills of Appleton, Wis. and can have an air permeability of about 25 cubic feet per minute per square foot.

The intermediate web 120A and the web imprinting surface 222 are positioned intermediate the first and second felt layers 320 and 360 in the compression nip 300. The first felt layer 320 is positioned adjacent the first face 122 of the intermediate web 120A. The web imprinting surface 222 is positioned adjacent the second face 124 of the web 120A. The second felt layer 360 is positioned in the compression nip 300 such that the second felt layer 360 is in flow communication with the deflection conduit portion 230.

Referring to FIGS. 1 and 4, the first surface 325 of the first dewatering felt 320 is positioned adjacent the first face 122 of the intermediate web 120A as the first dewatering felt 320 is driven over the belt 710. Similarly, the first surface 365 of the second dewatering felt 360 is positioned adjacent the second felt contacting face 240 of the foraminous imprinting member 219 as the second dewatering felt 360 is driven around the nip roll 362. Accordingly, as the intermediate web 120A is carried through the compression nip 300 on the foraminous imprinting fabric 219, the intermediate web 120A, the imprinting fabric 219, and the first and second dewatering felts 320 and 360 are pressed together between the opposed compression surfaces of the nip 300. Pressing the intermediate web 120A in the compression nip 300 further deflects the paper making fibers into the deflection conduit portion 230 of the imprinting member 219, and removes water from the intermediate web 120A to form the molded web 120B. The water removed from the web is received by and contained in the dewatering felts 320 and 360. Water is received by the dewatering felt 360 through the deflection conduit portion 230 of the imprinting member 219.

The intermediate web 120A should have a consistency of between about 14 and about 80 percent at the entrance to the compression nip 300. More preferably, the intermediate web 120A has a consistency between about 15 and about 35 percent at the entrance to the nip 300. The papermaking fibers in an intermediate web 120A having such a preferred consistency have relatively few fiber to fiber bonds, and can be relatively easily rearranged and deflected into the deflection conduit portion 230 by the first dewatering felt 320.

The intermediate web 120A is preferably pressed in the compression nip 300 at a nip pressure of at least 100 pounds per square inch (psi), and more preferably at least 200 psi. In a preferred embodiment, the intermediate web 120A is pressed in the compression nip 300 at a nip pressure greater than about 400 pounds per square inch.

The machine direction nip length can be between about 3.0 inches and about 20.0 inches. For a machine direction nip length between 4.0 inches to 10.0 inches, the press assembly 700 is preferably operated to provide between about 400 pounds of force per lineal inch of cross machine direction nip width and about 10000 pounds of force per lineal inch of cross machine direction nip width. The cross machine direction nip width is measured perpendicular to the plane of FIG. 4.

The nip pressure in psi is calculated by dividing the nip force exerted on the web by the area of the nip 300. The force exerted by the nip 300 is controlled by the pressure source P, and can be calculated using various force or pressure transducers familiar to those skilled in the art. The area of nip 300 is measured using a sheet of carbon paper and a sheet of plain white paper.

The carbon paper is placed on the sheet of plain paper. The carbon paper and the sheet of plain paper are placed in the compression nip 300 with the first and second dewatering felts 320, 360 and the imprinting member 219. The carbon paper is positioned adjacent the first dewatering felt 320 and the plain paper is positioned adjacent the imprinting member 219. The shoe press assembly 700 is then activated to provide the desired press force, and the area of the nip 300 at that level of force is measured from the imprint that the carbon paper imparts to the sheet of plain white paper. Likewise, the machine direction nip length and the cross machine direction nip width can be determined from the imprint that the carbon paper imparts to the sheet of plain white paper.

The molded web 120B is preferably pressed to have a consistency of at least about 30 percent at the exit of the compression nip 300. Pressing the intermediate web 120A as shown in FIG. 1 molds the web to provide a first relatively high density region 1083 associated with the web imprinting surface 222 and a second relatively low density region 1084 of the web associated with the deflection conduit portion 230. Pressing the intermediate web 120A on an imprinting fabric 219 having a macroscopically monoplanar, patterned, continuous network web imprinting surface 222, as shown in FIGS. 2–4, provides a molded web 120B having a macroscopically monoplanar, patterned, continuous network region 1083 having a relatively high density, and a plurality of discrete, relatively low density domes 1084 dispersed throughout the continuous, relatively high density network region 1083. Such a molded web 120B is shown in FIGS. 6 and 7. Such a molded web has the advantage that the continuous, relatively high density network region 1083 provides a continuous loadpath for carrying tensile loads.

Figure 8:
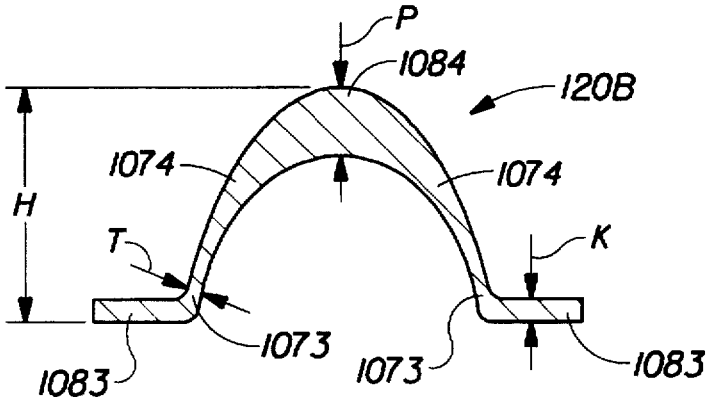
FIG. 8 is an enlarged view of the cross-section of the paper web shown in FIG. 7.

The molded web 120B is also characterized in having a third intermediate density region 1074 extending intermediate the first and second regions 1083 and 1084, as shown in FIG. 8. The third region 1074 comprises a transition region 1073 positioned adjacent the first relatively high density region 1083. The intermediate density region 1074 is formed as the first dewatering felt 320 draws papermaking fibers into the deflection conduit portion 230, and has a tapered, generally trapezoidal cross-section.

The transition region 1073 is formed by compaction of the intermediate web 120A at the perimeter of the deflection conduit portion 230. The region 1073 encloses the intermediate density region 1074 to at least partially encircle each of the relatively low density domes 1084. The transition region 1073 is characterized in having a thickness T which is a local minima, and which is less than the thickness K of the relatively high density region 1083, and a local density which is greater than the density of the relatively high density region 1083. The relatively low density domes 1084 have a thickness P which is a local maxima, and which is greater than the thickness K of the relatively high density, continuous network region 1083. Without being limited by theory, it is believed that the transition region 1073 acts as a hinge which enhances web flexibility. The molded web 120B formed by the process shown in FIG. 1 is characterized in having relatively high tensile strength and flexibility for a given level of web basis weight and web caliper H (FIG. 8).

The difference in density between the relatively high density region 1083 and the relatively low density region 1084 is provided, in part, by deflecting a portion of the embryonic web 120 into the deflection conduit portion 230 of the imprinting member 219 to provide a non-monoplanar intermediate web 120A upstream of the compression nip 300. A monoplanar web carried through the compression nip 300 would be subject to some uniform compaction, thereby increasing the minimum density in the molded web 120B. The portions of the non-monoplanar intermediate web 120A in the deflection conduit portion 230 avoid such uniform compaction, and therefore maintain a relatively low density.

The difference in density between the relatively high density region and the relatively low density region is also provided, in part, by pressing with both the first and second dewatering felts 320 and 360 to remove water from both faces of the web and prevent rewetting of the web. Water is expelled from the first and second web faces 122 and 124 as the intermediate web 120A is pressed in the compression nip 300. It is important that the water expelled from both faces of the web be removed from both faces of the web. Otherwise, the expelled water can re-enter the molded web 120B at the exit of the nip 300. For instance, if the dewatering felt 360 is omitted, water expelled from the second web face 124 into the deflection conduit portion 230 can re-enter the molded web 120B through the deflection conduit portion 230 of the imprinting member 219 at the exit of the nip 300.

Re-entry of water into the molded web 120B is undesirable because it decreases the consistency of the molded web 120B, and reduces drying efficiency. In addition, re-entry of water into the molded web 120B disrupts the fiber bonds formed during pressing of the intermediate web 120A and de-densifies the web. In particular, water returning to the molded web 120B will disrupt the bonds in the relatively high density region 1083, and reduce the density and load carrying capability of that region. Water returning to the molded web 120B can also disrupt the fiber bonds forming the transition region 1073.

The dewatering felts 320 and 360 prevent rewetting of the molded web through both web faces 122 and 124, and thereby help to maintain the relatively high density region 1083 and the transition region 1073. In some embodiments it can be desirable to remove the first dewatering felt 320 from the first face 122 of the molded web 120B at the exit of the compression nip 300 to prevent water held in the dewatering felt 320 from rewetting the first face 122 of the web. Similarly, it can be desirable to remove the second dewatering felt 360 from the imprinting member 219 at the nip exit to prevent water held in the dewatering felt 360 from re-entering the web through the deflection conduit portion 230. In the embodiment shown in FIGS. 1 and 4, the first and second dewatering felts 320 and 360 can be supported such that they are separated from the web at the exit of the nip 300.

Pressing the web, felt layers, and imprinting member in a nip having a machine direction length of at least about 3.0 inches can improve dewatering of the web. For a given paper machine speed, the relatively long nip length increases the residence time of the web and the felts in the nip. Accordingly, water can be more effectively removed from the web, even at higher machine speeds.

A sixth step in the practice of the present invention can comprise pre-drying the molded web 120B, such as with a through-air dryer 400 as shown in FIG. 1. The molded web 120B can be pre-dried by directing a drying gas, such as heated air, through the molded web 120B. In one embodiment, the heated air is directed first through the molded web 120B from the first web face 122 to the second web face 124, and subsequently through the deflection conduit portion 230 of the imprinting member 219 on which the molded web is carried. The air directed through the molded web 120B partially dries the molded web 120B. In addition, without being limited by theory, it is believed that air passing through the portion of the web associated with the deflection conduit portion 230 can further deflect the web into the deflection conduit portion 230, and reduce the density of the relatively low density region 1084, thereby increasing the bulk and apparent softness of the molded web 120B. In one embodiment the molded web 120B can have a consistency of between about 30 and about 65 percent upon entering the through air dryer 400, and a consistency of between about 40 and about 80 upon exiting the through air dryer 400.

Referring to FIG. 1, the through air dryer 400 can comprise a hollow rotating drum 410. The molded web 120B can be carried around the hollow drum 410 on the imprinting member 219, and heated air can be directed radially outward from the hollow drum 410 to pass through the web 120B and the imprinting member 219. Alternatively, the heated air can be directed radially inward (not shown). Suitable through air dryers for use in practicing the present invention are disclosed in U.S. Pat. No. 3,303,576 issued May 26, 1965 to Sisson and U.S. Pat. No. 5,274,930 issued Jan. 4, 1994 to Ensign et al., which patents are incorporated herein by reference. Alternatively, one or more through air dryers 400 or other suitable drying devices can be located upstream of the nip 300 to partially dry the web prior to pressing the web in the nip 300.

A seventh step in the practice of the present invention can comprise impressing the web imprinting surface 222 of the foraminous imprinting member 219 into the molded web 120B to form an imprinted web 120C. Impressing the web imprinting surface 222 into the molded web 120B serves to further density the relatively high density region 1083 of the molded web, thereby increasing the difference in density between the regions 1083 and 1084. Referring to FIG. 1, the molded web 120B is carried on the imprinting member 219 and interposed between the imprinting member 219 and an impression surface at a nip 490. The impression surface can comprise a surface 512 of a heated drying drum 510, and the nip 490 can be formed between a roll 209 and the dryer drum 510. The imprinted web 120C can then be adhered to the surface 512 of the dryer drum 510 with the aid of a creping adhesive, and finally dried. The dried, imprinted web 120C can be foreshortened as it is removed from the dryer drum 510, such as by creping the imprinted web 120C from the dryer drum with a doctor blade 524.

The method provided by the present invention is particularly useful for making paper webs having a basis weight of between about 10 grams per square meter to about 65 grams per square meter. Such paper webs are suitable for use in the manufacture of single and multiple ply tissue and paper towel products.

In an alternative embodiment of the present invention, the through air-dryer 400 in FIG. 1 can be omitted. The second felt 360 can be positioned adjacent the second face 240 of the imprinting member 219 as the molded web 120B is carried on the imprinting member 219 from the nip 300 to the nip 490. The nip 490 can be formed between a vacuum pressure roll and the Yankee drum 510.

Figure 5:
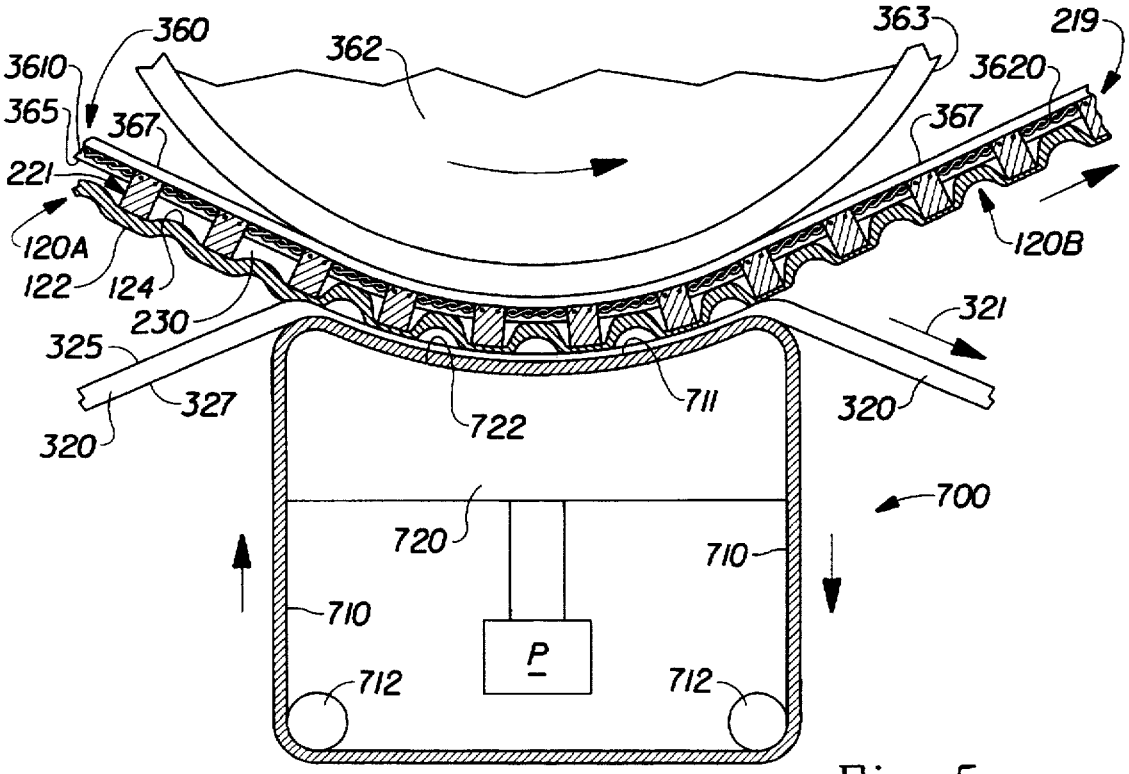
FIG. 5 is a schematic illustration of a compression nip according to an alternative embodiment of the invention, wherein the paper web is positioned between a first dewatering felt and a composite imprinting member comprising a foraminous web patterning layer formed from a photopolymer joined to the surface of a second dewatering felt, and wherein the web, the first felt, and the composite imprinting member are positioned between opposed convex and concave compression surfaces in the compression nip.
Figure 9:
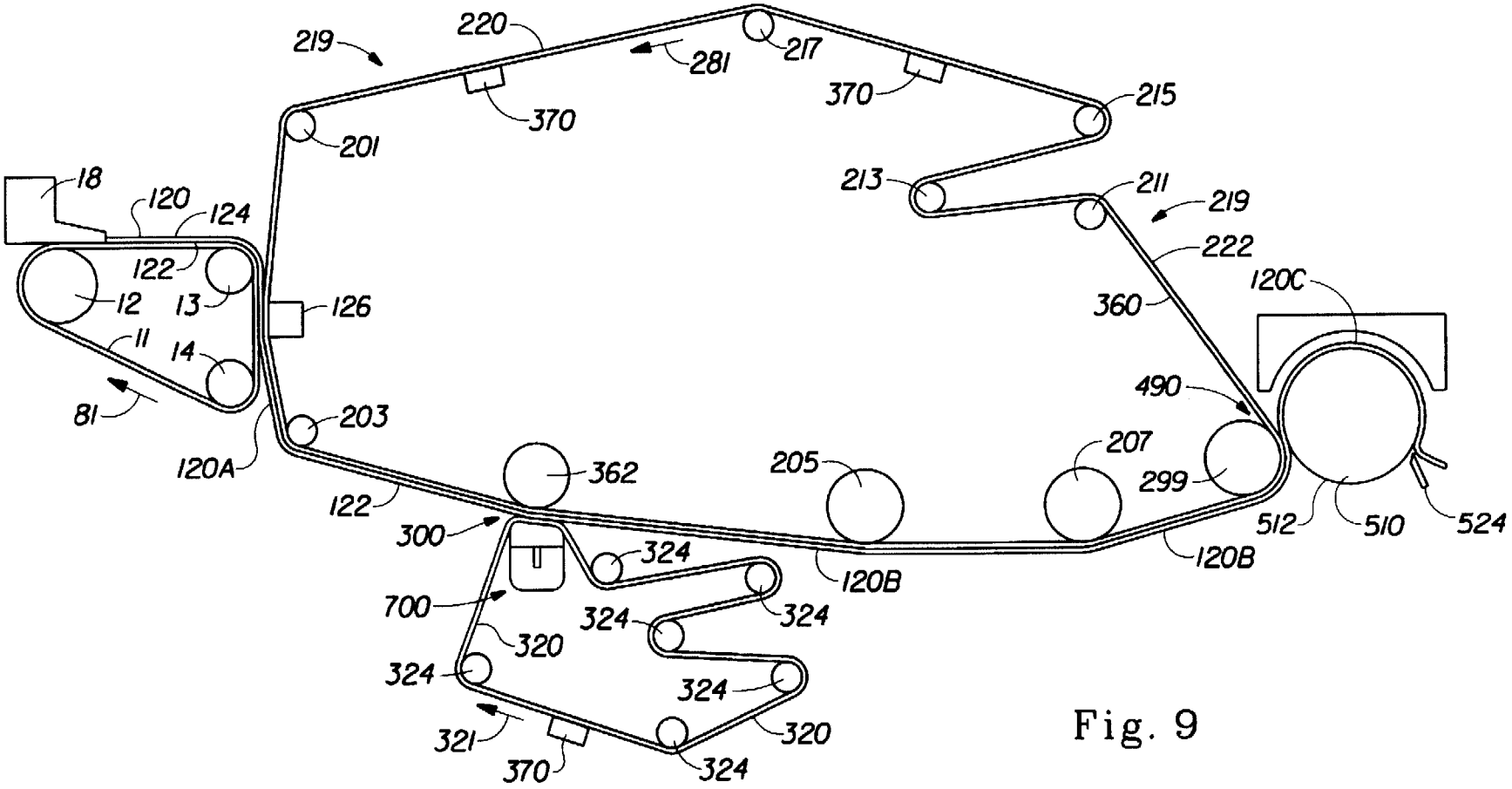
FIG. 9 is an alternative embodiment of a paper machine according to the present invention using the compression nip configuration shown in FIG. 5 and having a composite imprinting member comprising a foraminous web patterning layer formed from a photopolymer joined to the surface of a dewatering felt layer.
Figure 10:
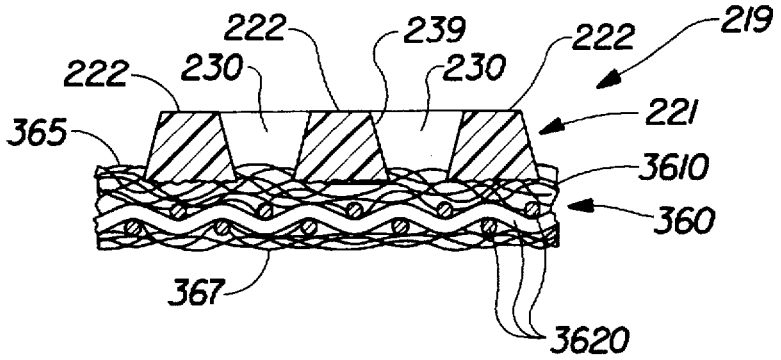
FIG. 10 is a schematic illustration of a cross-section of a composite imprinting member.

An alternative embodiment of the present invention employs a composite imprinting member 219, and is illustrated in FIGS. 5, 9 and 10. Referring to FIG. 10, the composite imprinting member 219 has a web patterning photopolymer layer 221 joined to the surface 365 of a dewatering felt 360. The dewatering felt 360 comprises a nonwoven batt 3610 which can be needled to a support structure comprising woven filaments 3620.

The photopolymer layer 221 has a macroscopically monoplanar, patterned continuous network web imprinting surface 222. Such a composite imprinting member 219 can comprise a photopolymer resin cast onto the surface of a dewatering felt. The following commonly assigned U.S. Patent Documents are incorporated herein by reference for the purpose of showing the construction of such a composite imprinting member: Ser. No. 08/461,832 "Web Patterning Apparatus Comprising a Felt Layer and a Photosensitive Resin Layer," filed Jun. 5, 1995 in the name of Trokhan, et al., which is a continuation in part of U.S. patent application Ser. No. 08/268,154 filed Jun. 29, 1994; U.S. Pat. No. 5,629,052 issued May 13, 1997, which is a continuation of U.S. Ser. No. 08/391,372 "Method of Applying a Curable Resin to a substrate for Use in Papermaking" filed Feb. 15, 1995 in the name of Trokhan et al.; and "High Absorbence/Low Reflectance Felts with a Pattern Layer" filed Apr. 30, 1996 in the name of Ampulski et al.

In FIG. 9, the embryonic web 120 is transferred to the photopolymer web imprinting surface 222 of the composite imprinting member 219. The web is pressed in the nip 300 between the first felt 320 and the composite imprinting member 219, which comprises the photopolymer web imprinting surface 222 and the second felt 360. The deflection conduits 230 of the patterned photopolymer layer 221 are in flow communication with the felt layer 360, as shown in FIG. 10.

FIG. 5 is an enlarged illustration of the nip 300 shown in FIG. 9. The force provided by the shoe press assembly urges the felt 320 against the web 120A, causing discrete portions of the web 120A to be deflected into the deflection conduits 230, and compacting a continuous network portion of the web 120A, thereby forming a molded web 120B. At the exit of the nip 300, the felt 320 is removed from the molded web 120, and the molded web is carried on the composite imprinting member 219.

The molded web 120B is carried on the web imprinting surface 222 of the composite web imprinting member to the nip 490. The nip 490 in FIG. 9 is formed between a pressure roll 299 and the Yankee drum 510. The pressure roll 299 can be a vacuum pressure roll which removes water from the second felt 360 at the nip 490, or alternatively, the pressure roll 299 can be a solid roll. With the composite imprinting member 219 positioned adjacent the face 124 of the molded web 120B, the web is carried on the composite imprinting member 219 into the nip 490 to transfer the molded web 120B to the Yankee drum 510.

While particular embodiments of the present invention have been illustrated and described, it would be obvious to those skilled in the art that various other changes and modifications can be made without departing from the spirit and scope of the present invention.

What is claimed:

1. A method of forming a paper web comprising the steps of:

providing an aqueous dispersion of papermaking fibers;

providing a foraminous forming member;

providing a first dewatering felt layer;

providing a second watering felt layer;

providing a compression nip having a machine direction length of at least about 3.0 inches, wherein the compression nip comprises convex and concave opposed compression surfaces;

providing an imprinting member having a web contacting face comprising a web imprinting surface and a deflection conduit portion;

forming an embryonic web of the papermaking fibers on the foraminous forming member, the embryonic web having a first face and a second face;

transferring the embryonic web from the foraminous forming member to the imprinting member to position the second face of the embryonic web adjacent the web contacting face of the foraminous imprinting member;

deflecting a portion of the papermaking fibers in the embryonic web into the deflection conduit portion and removing water from the embryonic web through the deflection conduit portion to form an uncompacted, non-monoplanar intermediate web of the papermaking fibers;

positioning the web intermediate the first and second felt layers in the compression nip, wherein the first felt layer is positioned adjacent the first face of the intermediate web, wherein the web imprinting surface is positioned adjacent the second face of the intermediate web, and wherein the deflection conduit portion is in flow communication with the second felt layer; and pressing the intermediate web in the compression nip to form a molded web.

2. The method of claim 1 wherein the step of pressing the intermediate web comprises pressing the intermediate web in a compression nip having a machine direction length of between about 3.0 to about 20.0 inches.

3. The method of claim 2 wherein the step of pressing the intermediate web comprises pressing the intermediate web in a compression nip having a machine direction length of between about 4.0 and about 10.0 inches.

4. The method of claim 1 wherein the step of pressing the intermediate web comprises pressing the intermediate web at a nip loading of between about 400 pounds per lineal inch of cross machine direction nip width and about 10000 pounds per lineal inch of cross machine direction nip width.

5. The method of claim 3 wherein the step of pressing the intermediate web comprises pressing the intermediate web at a nip loading of between about 400 pounds per lineal inch of cross machine direction nip width and about 10000 pounds per lineal inch of cross machine direction nip width.

6. The method of claim 1 further comprising the steps of:

separating the first dewatering felt layer from the first face of the molded web after the molded web passes through the compression nip;

supporting the molded web on the web imprinting surface after the molded web passes through the compression nip;

providing an impression surface;

impressing the web imprinting surface into the molded web by interposing the molded web between the web imprinting surface and the impression surface to form an imprinted web; and drying the imprinted web.

7. The method of claim 1 wherein the imprinting member has a web contacting face comprising a macroscopically monoplanar web imprinting surface.

8. The method of claim 7 wherein the imprinting member has a web contacting face comprising a macroscopically monoplanar, patterned, continuous network web imprinting surface defining within the foraminous imprinting member a plurality of discrete, isolated, non-connected deflection conduits.

9. The method of claim 1 wherein the imprinting member has a web contacting face comprising a plurality of discrete, isolated web imprinting surfaces.

10. The method of claim 1 wherein the imprinting member has a semi-continuous web imprinting surface.

11. The method of claim 1 wherein the imprinting member comprises a composite imprinting member having the web imprinting joined to the second felt layer.

12. The method of claim 11 wherein the imprinting member has a web contacting face comprising a macroscopically monoplanar, patterned, continuous network web imprinting surface defining within the foraminous imprinting member a plurality of discrete, isolated, non-connected deflection conduits.

13. The method of claim 11 wherein the imprinting member has a web contacting face comprising a plurality of discrete, isolated web imprinting surfaces.

14. The method of claim 1 comprising the steps of:

providing an imprinting member having a first web contacting face comprising a macroscopically monoplanar, patterned, continuous network web imprinting surface defining a plurality of discrete, isolated, non-connected deflection conduits; and pressing the intermediate web in the compression nip to form a molded web having a patterned continuous network region having a relatively high density, and a plurality of discrete domes having a relatively low density, the domes being dispersed throughout the continuous, relatively high density network region, and isolated one from another by, the relatively high density network region.

15. The method of claim 1 further including the step of creping the web.

16. A method of molding a paper web comprising the steps of:

providing a wet web of papermaking fibers, the paper web having a first face and a second face;

providing a first dewatering felt layer;

providing a compression nip having a machine direction length of at least about 3.0 inches, wherein the compression nip comprises convex and concave opposed compression surfaces;

providing an imprinting member having a first web contacting face and a second face, the web contacting face comprising a macroscopically monoplanar, patterned, continuous network web imprinting surface defining within the foraminous imprinting member a plurality of discrete, isolated, non connecting deflection conduits;

supporting the second face of the paper web on the web contacting face of the foraminous imprinting member;

positioning the first dewatering felt layer adjacent the first face of the paper web;

pressing the paper web, the foraminous imprinting member, and the first dewatering felt layer in the compression nip to form a molded web having a patterned continuous network region having a relatively high density, and a plurality of discrete domes having a relatively low density, the domes being dispersed throughout and isolated one from another by the relatively high density network.

17. The method of claim 16 wherein the step of pressing the intermediate web comprises pressing the intermediate web in a compression nip having a machine direction length of between about 3.0 to about 20.0 inches.

18. The method of claim 17 wherein the step of pressing the intermediate web comprises pressing the intermediate web in a compression nip having a machine direction length of between about 4.0 and about 10.0 inches.

19. The method of claim 18 wherein the step of pressing the intermediate web comprises pressing the intermediate web at a nip loading of between about 400 pounds per lineal inch of cross machine direction nip width and about 10000 pounds per lineal inch of cross machine direction nip width.

20. The method of claim 1 wherein each of the first and second dewatering felt layers comprises a nonwoven batt of fibers.

21. The method of claim 1 wherein each of the first and second dewatering felt layers has an air permeability of between about 15 and about 110 cubic feet per minute per square foot.

22. The method of claim 16 wherein the first dewatering felt layer comprises a nonwoven batt of fibers.

23. The method of claim 16 wherein the first dewatering felt layer has an air permeability of between about 15 and about 110 cubic feet per minute per square foot.

* * * * *

UNITED STATES PATENT AND TRADEMARK OFFICE

CERTIFICATE OF CORRECTION

PATENT NO. : 5,795,440

DATED : August 18, 1998

INVENTOR(S) : Robert Stanley Ampulski et al.

It is certified that error appears in the above-identified patent and that said Letters Patent is hereby corrected as shown below:

Column 5, line 21, delete "density" and insert therefor – densify --.

Column 5, line 37, delete "density" and insert therefor – densify --.

Column 17, line 62, delete "watering" and insert therefor – dewatering --.

Signed and Sealed this

Eleventh Day of May, 1999

*Attest:*

Q. TODD DICKINSON

*Attesting Officer*

*Acting Commissioner of Patents and Trademarks*